United States Patent [19]

Humbert

[11] 3,989,077

[45] Nov. 2, 1976

[54] ROTARY CUTTER

[75] Inventor: Manfred Humbert, Gutersloh-Isselhorst, Germany

[73] Assignee: Maschinenfabrik B. Maier KG, Brackwede, Germany

[22] Filed: Mar. 12, 1975

[21] Appl. No.: 557,667

[30] Foreign Application Priority Data

Mar. 13, 1974 Germany ..... 2411978

[52] U.S. Cl. ..... 144/230; 29/105 R; 83/698; 144/174; 241/292.1; 279/1 M

[51] Int. Cl.[2] ..... B27G 13/04

[58] Field of Search ..... 144/42, 162, 155, 172, 144/174, 218, 229, 230; 241/292.1, 293, 294, 295; 83/698, 926 C; 29/68, 78, 105 R, 105 A; 279/1 M

[56] References Cited

UNITED STATES PATENTS

| | | | |
|---|---|---|---|
| 1,315,536 | 9/1919 | Usher | 144/230 X |
| 3,014,511 | 12/1961 | Kirsten | 144/230 |
| 3,256,043 | 6/1966 | Krikeler | 279/1 M X |

FOREIGN PATENTS OR APPLICATIONS

| | | | |
|---|---|---|---|
| 1,344,960 | 10/1963 | France | 144/218 |

*Primary Examiner*—Othell M. Simpson
*Assistant Examiner*—W. D. Bray
*Attorney, Agent, or Firm*—Michael J. Striker

[57] ABSTRACT

A cutter for removing chips from wood has a rotary carrier whose peripheral surface is formed with rearwardly and inwardly inclined recesses for permanent magnets which attract plate-like blades having cutting edges which extend radially outwardly beyond the peripheral surface of the carrier. The blades consist of magnetic material and are attracted to the permanent magnets. The magnets have dovetailed projections extending into complementary grooves of the carrier. Each blade is urged against the respective magnet by a spring-biased wedge in the respective recess, and the inner edge of each blade bears against a plate-like abutment which is attracted to the respective magnet.

12 Claims, 2 Drawing Figures

A
4a
4
5
3
9
6a
II
6
1a
1
11
1b
6b
10
13
12
7
8a
8
II
2
13a
1c
14

9
11
6a
6
6b
7
10
12

ROTARY CUTTER

CROSS-REFERENCE TO RELATED APPLICATIONS

The rotary cutter of the present invention constitutes an improvement over and a further development of cutters which are disclosed in the commonly owned copending applications Ser. Nos. 490,216 and 493,062 of Maier filed July 19 and July 30, 1974.

BACKGROUND OF THE INVENTION

The present invention relates to rotary cutters, especially to cutters wherein a rotary support mounts one or more detachable blades serving to remove chips, shavings or other types of fragments from wood or the like.

It is known to utilize in a rotary wood cutter a cylindrical carrier whose peripheral surface is formed with rearwardly and inwardly inclined recesses for discrete plate-like blades and wedges which are biased by springs and serve to urge the blades against suitable holders which are secured to the carrier. It is also known to provide in such carriers suitable abutments for the rear or inner edges of the blades; the abutments may constitute integral parts of the carrier or they constitute adjustable strips which are separably mounted in the respective recesses. In many instances, the blades are secured to their holders by means of screws so that each blade constitutes with the respective holder a package or group which is removably insertable into the corresponding recess of the carrier. For example, each holder may be provided with a dovetailed projection which is receivable in a complementary groove machined into the carrier and extending in parallelism with the axis of rotation of the cutter. Reference may be had to German Offenlegungsschrift No. 2,159,033 or 2,220,003. When a blade having a dull cutting edge is to be replaced, the entire package must be removed from the corresponding recess, the blade detached from the associated holder, and a new blade fastened to such holder before the package is ready for insertion into the carrier. Prior to insertion of a package, the latter is introduced into a device wherein the position of the new blade with respect to the holder is adjusted to insure that the cutting edge of the new blade will protrude beyond the periphery of the carrier and that the extent of such protrusion will be within a desired range.

The just described mode of replacing worn blades is complicated and takes up too much time so that the cutter is idle at frequent intervals and for extended periods of time. Proposals to reduce the intervals of idleness of the cutter include the provision of spare holders which are assembled with satisfactory blades while the cutter is in use so that the replacement of a damaged or worn blade takes up only as much time as is needed to remove a holder from its recess and to insert a spare holder which is properly connected with a satisfactory blade. The utilization of spare holders contributes significantly to the initial cost of the cutter because the latter must be furnished with a number of blades and holders which greatly exceeds the number of recesses in the rotary carrier. Moreover, the workman who is in charge of replacing dull blades must be present at all times so that he cannot perform other duties in the plant where the cutter is being put to use with a large number of similar cutters or with other woodworking instrumentalities.

SUMMARY OF THE INVENTION

An object of the invention is to provide a rotary cutter which is constructed and assembled in such a way that the replacement of damaged or worn blades with fresh blades takes less time than in heretofore known cutters even though the improved cutter need not be furnished with spare holders.

Another object of the invention is to provide novel holders and blades for use in the improved rotary cutter.

A further object of the invention is to provide a rotary cutter wherein the blade can be readily applied against and retained by the holder even if the connection between the blade and the holder does not include screws, bolts or analogous parts which must be manipulated by screwdrivers, wrenches or other types of tools.

An additional object of the invention is to provide a rotary cutter with novel and improved abutments for the rear or inner edges of plate-like material removing blades.

Still another object of the invention is to provide a novel and improved support for the blades in a rotary cutter for wood or the like.

A further object of the invention is to provide a rotary cutter which can be used as a simpler, less expensive, longer lasting and more rugged substitute for conventional rotary cutters.

The invention is embodied in a cutter for removing fragments from wood or the like. The cutter comprises a rotary support which is rotatable in a predetermined direction by a motor or the like and has a peripheral surface provided with a least one recess and holder means disposed in the recess, removable plate-like blade means disposed in the recess and having a first side adjacent to the holder means, a second side facing forwardly and away from the holder means, a cutting edge extending from the recess (i.e., at least slightly beyond the peripheral surface of the support), and a device (e.g., a wedge and resilient means bearing against the wedge and reacting against the support) for biasing the blade means against the holder means. The wedge engages the second side of the blade means and is urged against the latter by the aforementioned resilient means and preferably also by centrifugal force when the support rotates.

In accordance with a feature of the invention, one of the parts including the holder means and blade means is a permanent magnet and the other of these parts consists of magnetic (preferably ferromagnetic) material so that the blade means is attracted to the holder means. For example, the holder means may constitute a permanent magnet and is preferably formed with a dovetailed projection extending in parallelism with the axis of the support and into a complementary dovetailed groove in a carrier which constitutes a main component part of the support. The latter preferably further comprises a substantially plate-like abutment which engages a second edge of the blade means, namely, that edge which is located opposite the cutting edge. The blade means and the abutment may be formed with elongated slots extending substantially radially of the support, and the holder means is then provided with cylindrical studs or analogous projections which extend into the slots to hold the blade means and the abutment against any movement axially of the support but to permit adjustments of the blade means and abutment substantially radially of the support, e.g., to adjust the initial position of the cutting edge or to compensate to wear upon the cutting edge.

The novel features which are considered as characteristic of the invention are set forth in particular in the appended claims. The improved rotary cutter itself, however, both as to its construction and its mode of operation, together with additional features and advantages thereof will be best understood upon perusal of the following detailed description of certain specific embodiments with reference to the accompanying drawing.

DESCRIPTION OF THE PREFERRED EMBODIMENTS

Figure 1:
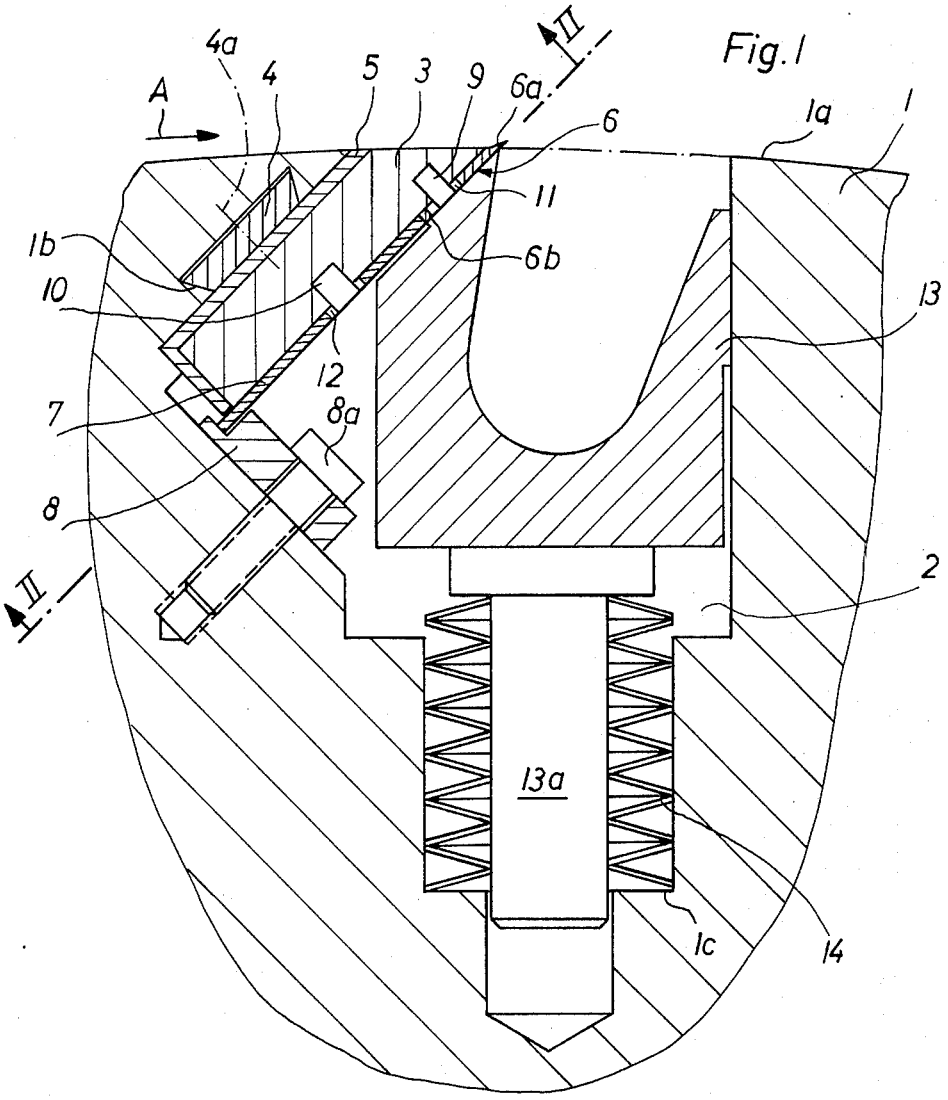
FIG. 1 is a fragmentary transverse sectional view of a rotary cutter which embodies the invention.

FIG. 1 shows a rotary cutter which includes a support for one or more plate-like blades 6 (only one shown). The support comprises a rotary cylindrical, conical or hyperboloidal carrier 1 whose axis of rotation is normal to the plane of FIG. 1 and whose peripheral surface 1*a* is formed with one or more recesses 2, one for each blade 6. The support further comprises a discrete holder or holding means 3 and a discrete plate- or strip-like abutment 7 for each blade 6. The holder 3 which is shown in FIG. 1 is provided with a separable dovetailed projection or tongue 4 which is secured thereto by one or more screws 4*a* (one indicated by a phantom line). The tongue 4 is received in a complementary dovetailed groove 1*b* which is machined into carrier 1 and extends in parallelism with the axis of rotation of the support. The carrier 1 is driven by a motor (not shown) to rotate in a clockwise direction (see the arrow A), i.e., the blade 6 and the holder 3 are located in the trailing portion of the recess 2, as considered in the direction of arrow A. The left-hand side of the blade 6 lies flush against the adjacent side of the holder 3, and the right-hand side of the blade 6 is engaged by the adjacent portion of a wedge 13 forming part of a means for biasing the blade 6 against the holder 3. The wedge 13 is received in the recess 2 and is biased outwardly by centrifugal force as well as by resilient means including a package of dished springs 14 which surround a stub 13*a* forming part of the wedge and extending radially inwardly toward the axis of the support. The innermost spring 14 reacts against a shoulder 1*c* in the innermost portion of the recess 2. The blade 6 is inclined inwardly and rearwardly, as considered in the direction of rotation of the carrier 1, and its cutting edge 6*a* protrudes beyond the peripheral surface 1*a* so that it removes fragments from a piece of wood which is to be comminuted by the cutter. The second or inner edge 6*b* of the blade 6 bears against the plate- or strip-shaped abutment 7 which in turn abuts against the inner portion of the right-hand side of the holder 3 and whose inner edge bears against an adjustable and/or removable anvil or stop 8 forming part of the support and being separably secured to the carrier 1 by a screw 8*a* or by an analogous fastener.

The holder 3 is a permanent magnet and the blade 6 consists of magnetic material (e.g., steel) or vice versa so that the blade is attracted to the holder even if the wedge 13 is retracted against the opposition of the springs 14. The abutment 7 also consists of magnetic material so that it adheres to the holder 3. If desired, a diamagnetic insert (e.g., a sheet consisting of brass) may be placed between the tongue 4 and the left-hand side of the holder 3, as viewed in FIG. 1. The insert 5 can extend all the way to the peripheral surface 1*a* and preferably overlies the right-hand side as well as the inner side of the holder, i.e., this insert can extend all the way to the abutment 7. The blade 6 is assumed to be expendable, i.e., it is not intended to be sharpened but is simply discarded as soon as its cutting edge 6*a* is sufficiently dull to warrant replacement with a new blade. When the carrier 1 rotates clockwise and the cutting edge 6*a* removes material from a workpiece, the inner edge 6*b* of the blade bears against the abutment 7 and the latter bears against the stop 8. The position of the abutment 7, as considered in the radial direction of the carrier 1, can be adjusted by placing one or more shims between the stop 8 and the adjacent surface of the carrier or by replacing this stop with a differently dimensioned stop.

Figure 2:
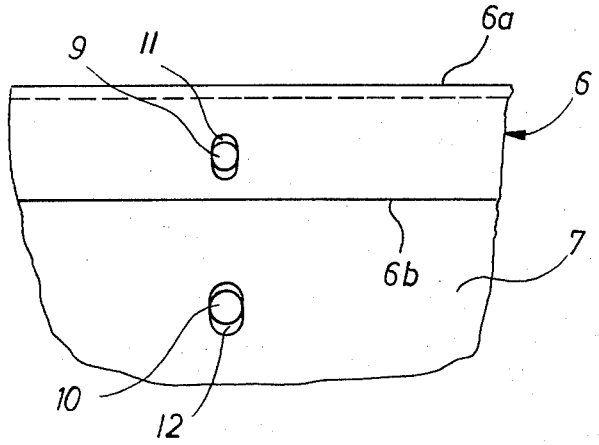
FIG. 2 is a fragmentary plan view of the blade and of an abutment therefor, substantially as seen in the direction of arrows from the line II-II of FIG. 1.

The blade 6 is held against movement in the axial direction of the carrier 1. To this end, the blade is formed with one or more elongated slots 11 (see FIG. 2) which extend substantially radially of the carrier 1 and each of which receives a preferably cylindrical stud 9 or an analogous projection of the holder 3. The diameter of the stud 9 equals the width of the slot 11 so that the blade 6 is held against movement at right angles to the plane of FIG. 1; however, the stud 11 allows the blade 6 to move (within limits) substantially radially of the carrier. A similar elongated slot 12 is provided in the abutment 7 to receive a cylindrical stud 10 of the holder 3; the stud 10 holds the abutment 7 against movement in the axial direction of the carrier 1 but allows the abutment to move (within limits) in the longitudinal direction of the slot 12. The studs 9 and 10 constitute a simple but reliable safety device in that they prevent the blade 6 and abutment 7 from being propelled from the recess 2 when the carrier 1 is driven to rotate at a high speed.

When the cutting edge 6*a* is sufficiently dull to warrant replacement of the blade 6 with a new blade, the carrier 1 is arrested, the wedge 13 is depressed into the recess 2 against the opposition of the springs 14, and the blade 6 is simply lifted off the projection 9. Thus, the holder 3 need not be detached at all, and the abutment 7 also continues to adhere to the holder while the blade 6 is being discarded to be replaced with a fresh blade. Consequently, the removal of a previously used blade and the insertion of a fresh blade take up a very short interval of time. The operator's hand can readily overcome the magnetic force with which the blade 6 is attracted to the holder 3. On the other hand, such force is sufficient to insure that the blade 6 cannot fall deeper into or escape from the recess 2 when the wedge 13 is moved away from its right-hand side, as viewed in FIG. 1. If necessary, a freshly inserted new blade can be shifted relative to the holder 3 so that its rear or inner edge 6*b* is in full fact-to-face contact with the abutment 7 before the wedge 13 is released to engage the new blade and to urge it against the holder 3 in such position that the stud 9 extends into the slot 11. It has been found that the omission of screws which serve to attach blades to the holders of conventional rotary cutters brings about a substantial reduction of the length of interval which is needed to replace a damaged or dull blade with a new blade.

Instead of disposing the holder and blade means at the trailing end of the recess, in another embodiment of the invention it may also be disposed at the leading end of the recess.

Without further analysis, the foregoing will so fully reveal the gist of the present invention that others can by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

I claim:

1. A cutter for removing fragments from wood or the like, comprising a support arrangement mounted for rotation in a predetermined direction, said support arrangement having a peripheral surface, a recess in said surface and holder means disposed in said recess, removable plate-like blade means disposed in said recess, said blade means having a first side adjacent to said holder means, a second side and a cutting edge extending from said recess, said holder means constituting a permanent magnet and said blade means consisting of magnetic material so that said blade means is attracted to said holder means; and a device for biasing said blade means against said holder means.

2. A cutter as defined in claim 1, wherein said biasing means comprises a wedge abutting against said second side of said blade means and resilient means urging said wedge against said side of said blade means.

3. A cutter as defined in claim 1, wherein said blade means has a second edge opposite said cutting edge and said support arrangement further comprises an abutment for said second edge.

4. A cutter as defined in claim 1, wherein said blade means has a second edge disposed opposite said cutting edge and said support arrangement further comprises a plate-like abutment engaging said second edge of said blade means, said abutment consisting of magnetic material and being attracted to said holder means.

5. A cutter as defined in claim 4, wherein said support arrangement comprises a carrier for said holder means and an adjusting element secured to said carrier and constituting a stop said abutment.

6. A cutter as defined in claim 1, wherein the holder means are disposed at the trailing end of the recess, as considered in the predetermined direction.

7. A cutter as defined in claim 1, wherein said support arrangement comprises a carrier and means for securing said holder means to said carrier.

8. A cutter as defined in claim 7, wherein said blade means has an elongated slot extending substantially radially of said support arrangement and said holder means has a projection extending into said slot to hold said blade means against movement axially of said support arrangement but to permit radial shifting of said blade means with respect to said support arrangement.

9. A cutter as defined in claim 1, wherein said support arrangement comprises a carrier having a dovetailed groove extending in parallelism with the axis of said support arrangement, said holder means having a complementary projection extending into said dovetailed groove of said carrier.

10. A cutter as defined in claim 1, wherein said support arrangement comprises a discrete carrier for said holder means and an insert consisting of diamagnetic material and being interposed between said carrier of said support arrangement and said holder means.

11. A cutter as defined in claim 1, wherein said blade means has a second edge located opposite said cutting edge and said support arrangement comprises a carrier, means for separably securing said holder means to said carrier of said support arrangement, and an abutment consisting of magnetic material and being attracted to said holder means, said abutment and said blade means having elongated slots extending substantially radially of said support arrangement and said holder means having projections extending into said slots to hold said blade means and said abutment against movement axially of said support arrangement but to permit adjustments of said blade means and said abutment substantially radially of said support arrangement.

12. A cutter for removing fragments from wood or the like, comprising a support arrangement mounted for rotation in a predetermined direction, said support arrangement having a peripheral surface, a recess in said surface and holder means disposed in said recess, removable plate-like blade means disposed in said recess, said blade means having a first side adjacent to said holder means, a second side and a cutting edge extending from said recess, said blade means constituting a permanent magnet, and said holder means consisting of magnetic material so that said blade means is attracted to said holder means; and a device for biasing said blade means against said holder means.

* * * * *